US009555553B2

(12) United States Patent
Rutan et al.

(10) Patent No.: US 9,555,553 B2
(45) Date of Patent: Jan. 31, 2017

(54) SLITTER BLADE GUARD

(71) Applicant: Maxcess International, Camas, WA (US)

(72) Inventors: Chris Rutan, West Linn, OR (US); Jeff Hendricks, Camas, WA (US); Richard Holbert, Brush Prairie, WA (US)

( * ) Notice: Subject to any disclaimer, the term of this patent is extended or adjusted under 35 U.S.C. 154(b) by 489 days.

(21) Appl. No.: 13/848,907

(22) Filed: Mar. 22, 2013

(65) Prior Publication Data

US 2013/0247390 A1 Sep. 26, 2013

Related U.S. Application Data

(60) Provisional application No. 61/605,175, filed on Mar. 23, 2012.

(51) Int. Cl.

| | |
|---|---|
| ***B26D 7/22*** | (2006.01) |
| ***B26D 7/26*** | (2006.01) |
| ***B26D 7/00*** | (2006.01) |

(52) U.S. Cl.

CPC . *B26D 7/22* (2013.01); *B26D 7/00* (2013.01); *B26D 7/2635* (2013.01); *Y10T 83/606* (2015.04); *Y10T 83/7734* (2015.04)

(58) Field of Classification Search

CPC ..... Y10T 83/7734; Y10T 83/606; Y10T 74/2191; B27G 19/00; B27G 19/02; B27G 19/04; B26F 1/14–1/24; B24B 55/052; B26D 7/22; B26D 7/2635

USPC .... 83/478, 397–398, 500, 508.1–508.2, 504, 83/DIG. 1; 144/251.1, 251.3; 30/391, 292

See application file for complete search history.

(56) References Cited

U.S. PATENT DOCUMENTS

| | | | | | |
|---|---|---|---|---|---|
| 1,880,885 | A * | 10/1932 | Dittmar | B23Q 1/40 | 83/435.11 |
| 1,925,181 | A * | 9/1933 | Fassin | G01N 1/06 | 83/397 |
| 2,801,654 | A * | 8/1957 | Utz | B27G 19/04 | 144/251.1 |
| 4,041,823 | A | 8/1977 | Ashbrook | | |
| 4,905,424 | A | 3/1990 | Nagashima | | |
| 5,070,751 | A * | 12/1991 | Harris | B23D 55/084 | 83/62.1 |
| 5,237,897 | A * | 8/1993 | Wijesinghe | B23D 55/10 | 83/72 |
| 5,531,147 | A * | 7/1996 | Serban | B27B 5/32 | 144/251.1 |
| 5,546,840 | A | 8/1996 | Supe-Dienes | | |
| 5,864,952 | A * | 2/1999 | Chung | B26B 5/001 | 30/162 |
| 6,378,408 | B2 * | 4/2002 | Smith | B23D 59/001 | 700/193 |

(Continued)

FOREIGN PATENT DOCUMENTS

| | | | | |
|---|---|---|---|---|
| EP | 0775548 | * | 5/1997 | B23D 59/006 |
| GB | 641772 | * | 8/1950 | B23D 59/006 |

OTHER PUBLICATIONS

EP0775548 english translation; May 1997 ; EPO; Hartmut, Walter.*

*Primary Examiner* — Laura M Lee
(74) *Attorney, Agent, or Firm* — Robert Anton Pasic

(57) ABSTRACT

A retractable safety cover for a slitting blade edge. This cover pivots about an axis that is perpendicular to the axis of rotation of the blade edge. The cover is spring loaded in the open direction and is held in the covered orientation by a spring loaded moveable block. By retracting the moveable block the blade edge is exposed for use.

3 Claims, 9 Drawing Sheets

(56) References Cited

U.S. PATENT DOCUMENTS

| | | | | |
|---|---|---|---|---|
| 6,463,352 | B1 * | 10/2002 | Tadokoro | G05B 19/4187 700/159 |
| 6,857,939 | B2 | 2/2005 | Adachl | |
| 7,223,163 | B2 | 5/2007 | Neumeier | |
| 2008/0127793 | A1 * | 6/2008 | Ikeda | G01H 1/003 83/73 |
| 2008/0295337 | A1 * | 12/2008 | Glesser | B26B 1/04 30/161 |

* cited by examiner

SLITTER BLADE GUARD

CROSS-REFERENCE TO RELATED APPLICATIONS

This application claims the priority date of provisional patent 61/605,175 and is included by reference in this document.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The invention relates to the web manufacturing industry. Materials like paper, films and various laminates are typically manufactured as a continuous sheet or web of material. During the processing of a continuous web, the web is handled by cylindrical rolls and cut into continuous strips. This cutting is typically required for downstream handling or for producing a final product such as a roll of tape.

The instant invention is an accessory for use on a typical slitting device. The slitting device includes a sharp circular blade and a blade actuator referred to as a knifeholder. The knifeholder typically includes a means of extending and translating the circular blade into an anvil or cutting edge. The invention is a guard that covers the blade while the slitter is not engaged with the anvil or cutting edge.

The prior art cited in U.S. Pat. No. 5,546,840 Dienes teaches a guard mechanism which is manually set and pivots along the circumference of the blade. This exposes the operator to the blade and the operator can be cut by the blade during handling. If the operator elects not to use the guard, for instance, the guard will not be covering the blade and he/she can easily be cut by the blade. Especially during maintenance when the knife holder is removed from supporting equipment.

Other prior art is cited which includes U.S. Pat. No. 4,905,424 Nagashima. This patent teaches the use of two side plates which are D-shaped to surround the exposed half of a circular blade. This invention requires the operator to connect the edges of the two side plates and so while the operator is attaching the two side plates he or she is exposed to the sharp edge of the blade.

U.S. Pat. No. 441,823 Ashbrook discloses a guard for a web slitter. This patent also teaches a two piece guard. One guard piece is attached to a body that supports a circular blade. This guard is manually adjustable along with the circular blade. A second guard piece overs all of the blade but a small cutting area. This cover is attached to the other guard by screws engaging slots on the second guard. These screws and slots are used to adjust the amount of blade exposed for cutting. In this case the blade is exposed during handling of the slitter.

U.S. Pat. No. 6,857,939 Adachi, teaches a guard mechanism that includes an interlock device. The guard mechanism consists of a static guard and a pivoting guard. The pivoting guard pivots away from the cutting edge of the blade about an axis that is parallel to the axis of rotation of the circular blade. This increases the amount of space required. The interlock device prevents a blade attaching and detaching device being attached when the cover is in a closed position. In this invention the blade is only guarded while attached to the slitting assembly and the cutting portion is still exposed to an operator.

U.S. Pat. No. 7,223,163 Neumeier, teaches a two piece guard in which a pivoting piece rotates about an axis parallel to the axis of rotation of the blade. This guard is also manually adjusted and so relies on the operator to extend the pivoting piece when the device is not in use.

U.S. Pat. No. 7,628,682 Andrasic, teaches a detachable guard. This guard consists of two sections, a cover section and an attaching section. The guard section is semi-circular in shape, the gripping section is attached to the guard section at the center of the semi-circular radius. The gripping section includes a handle which engages teeth and pivots into a locking position while gripping a cylindrical tool housing.

The applicant is also aware of a guard fitted to a slitter which was/is provided by Dienes. A patent covering this design was not found. This guard included a semi-circular piece, a flexible mounting for the semi-circular piece and features located on a vertical blade actuator. In this design the vertical actuator moves the blade vertically toward an anvil. During this movement the features on the actuator cause the guard to flex away from the blade. This movement allows the blade to extend toward the anvil and the guard simultaneously moves out of the way. This design however does not provide adequate protection for an operator. The flexible guard can easily be pushed in such a way to expose the cutting edge of the blade possibly injuring the operator.

BRIEF SUMMARY OF THE INVENTION

In view of the previously mentioned prior art, the present invention discloses an improved guard device for use with a web slitter. One improvement is a guard which retracts as the slitter is moved into the slitting position. A second improvement is a guard which is locked into a state such that the blade edge is shielded from operators while they are handling the device during maintenance. A third improvement is a guard which pivots in an axis that is perpendicular to the blade rotation axis. This pivoting keeps the guard within the width of the knife holder and therefore requires no additional transverse space while retracted.

The invention retracts the guard as the blade is moved vertically into the slitting position. In one embodiment the blade is moved vertically by a blade extension fluid cylinder and the guard is also actuated by a similar but guard cylinder. Both the cylinders include return springs which hold the two actuators in a fixed position. This fixed position is a position such that the blade is retracted and the guard is extended (or pivoted) so that the edge of the blade is covered. The first cylinder return spring is a relatively stiff spring and the second cylinder is a relatively soft return spring. The first and second cylinders are connected to the same fluid input source. When source pressure increases both cylinders start to building pressure. As pressure builds on the supply line the first cylinder is held in place while the second cylinder, due to the softer spring retracts and the guard likewise retracts due to the action of a biasing spring. Once the guard is retracted the pressure continues to build in the first cylinder. The additional pressure overcomes the first cylinder return spring and the blade extends into the cutting position.

The invention also extends the guard in a similar manner. As pressure decreases the second cylinder stays in the guard retracted position until the pressure is below a specific level, however the stiffer return spring of the first cylinder causes the blade to retract. This allows the guard to extend over the blade after the blade has retracted.

The invention also locks the guard into a position which covers the blade edge. In this state the guard return spring holds the guard in position and the first cylinder return spring holds the blade in the retracted (non-slitting) position. In order to lock the guard in this position a block attached to the guard cylinder is positioned such that the guard cannot pivot and expose the blade edge. However, if one would like to expose the blade this can easily be done. The block, mentioned above, must be pushed against the second return spring, thus moving the block from obstructing the guard. This allows a torsion spring, which biases the guard against the block, to pivot the guard from the blade. To prevent accidental guard retraction, the block is only accessible on one side.

To briefly recap, a means of either extending the guard or retracting the guard is provided such that the slitter blade is clear of the guard during these operations. Also, a means of holding the guard in place while the slitter is not in the slitting position is provided. Yet another advantage is a means or manual retraction of the guard which requires a specific manual action.

Additionally, when no air pressure is present the guard is extended and locked so a maintenance person is not required to perform the locking function.

DETAILED DESCRIPTION OF PREFERRED EMBODIMENT

Figure 1:
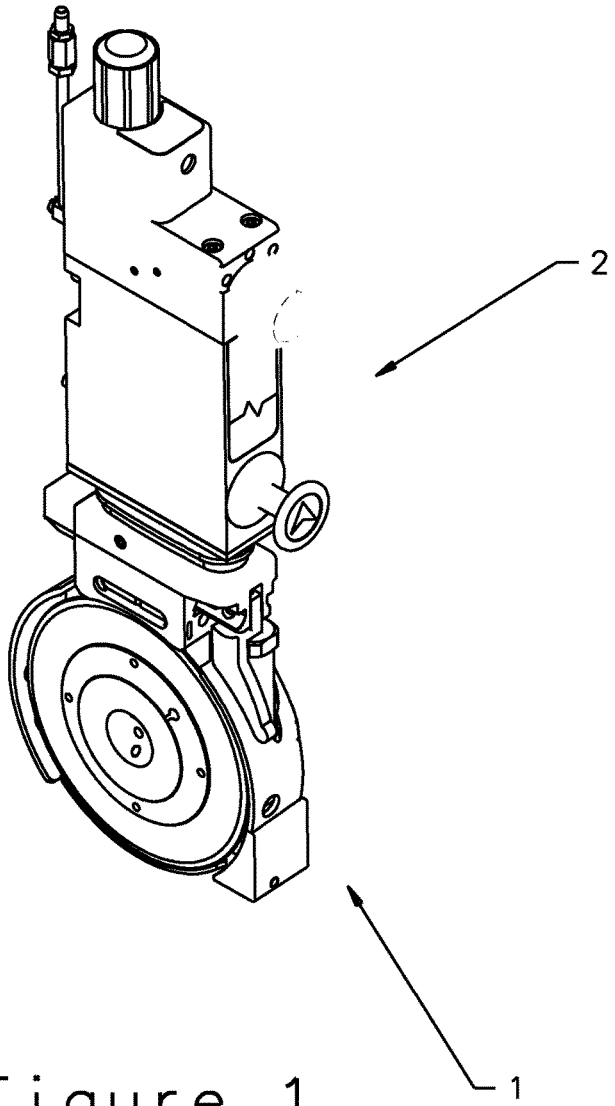
FIG. 1 is an Upper, Left isometric view of the Knife holder with the slitter blade guard.
Figure 2:
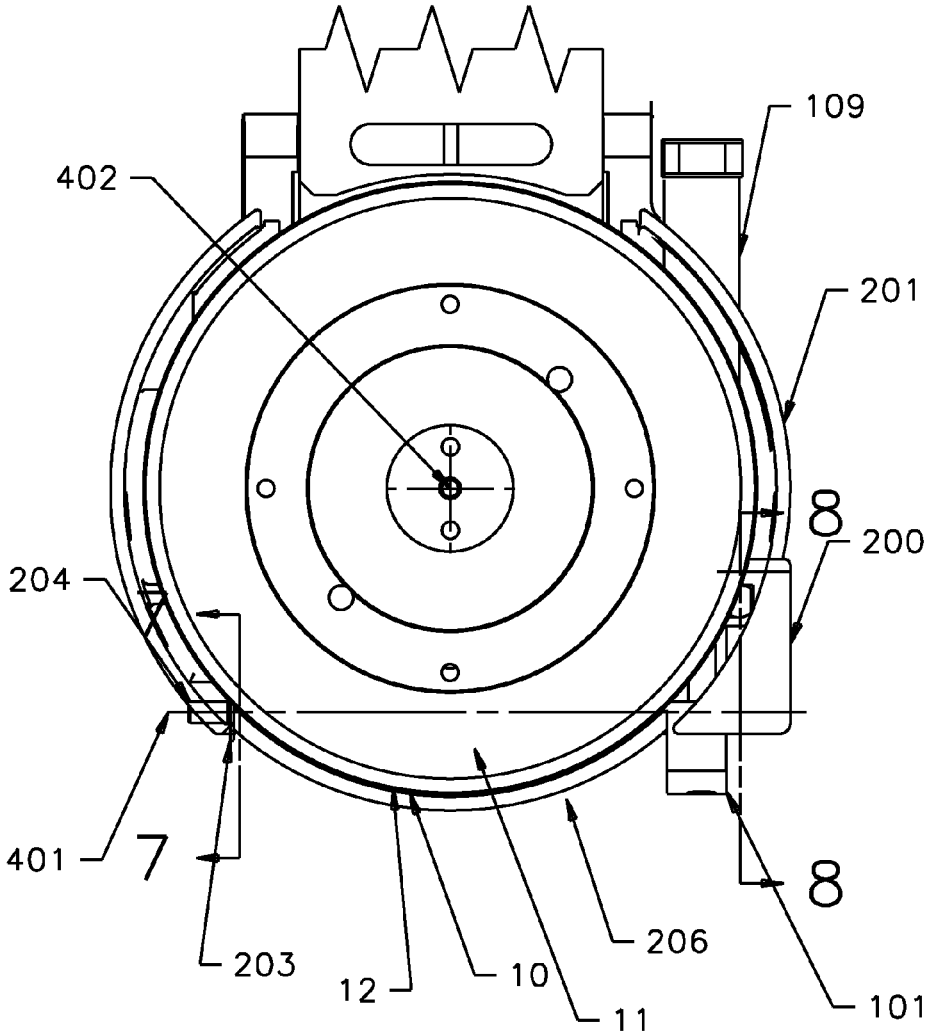
FIG. 2 is a left side view of the slitter blade and slitter blade guard with the guard in the blade covering position.
Figure 6:
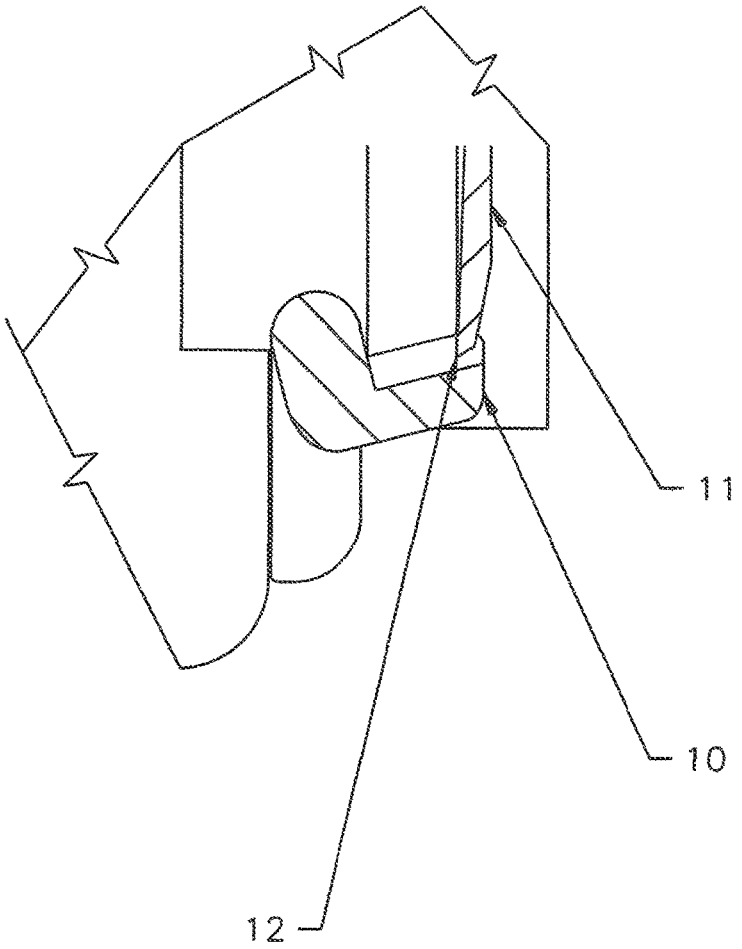
FIG. 6 is a partial section view of the blade guard covering the blade in the not slitting position.
Figure 7:
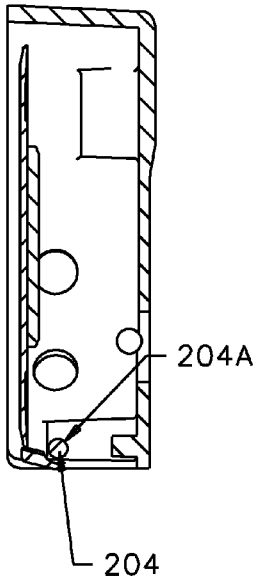
FIG. 7 is a partial section view of the blade guard pivot on the front side, this section taken along line E-E of FIG. 2.
Figure 8:
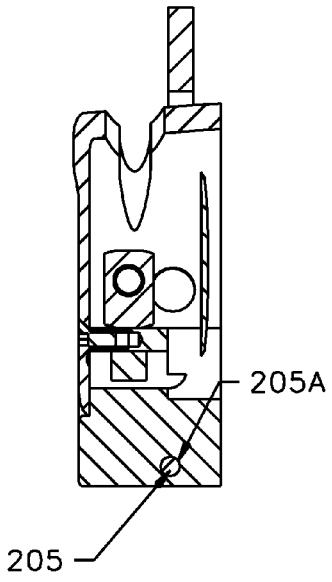
FIG. 8 a partial section view of the blade guard pivot on the rear side this section taken along line D-D of FIG. 2.

Referring to FIG. 1, the slitter blade guard 1 is mounted to a web slitter knife holder 2 for which it is used to guard personnel from the web slitter slitting blade edge 12 in FIG. 6. In the embodiment shown in FIG. 2 the web slitter cover 201 acts as a mounting base for the device 1. A guard 206 is supported in the web slitter cover 201 on two pivots 204 and 205. In this embodiment the guard is formed in an arc 405 and also has a lip 10 which covers the edge 12 of the web slitter blade 11 as shown best in FIG. 6. The web slitter cover 201 provides pivot surfaces 204A and 205A which support the guard 202 at the respective guard pivots 204 and 205 these features are best illustrated with reference to FIGS. 2, 7 and 8. This construction provides for pivoting the guard 206 about an axis 401 which is perpendicular to the web slitter blade axis 402. In this construction the guard 206 need not move far to completely expose the web slitter blade edge 12 to the slitting area 303 of FIG. 3.

Figure 4:
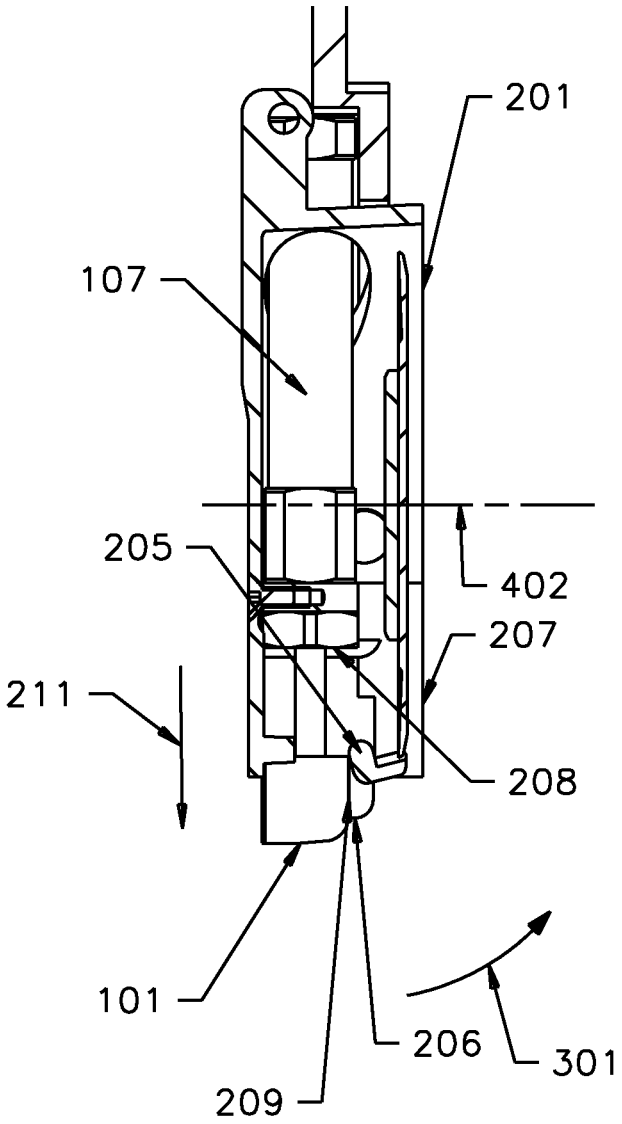
FIG. 4 is a section view of the guard actuation device, which in this view is shown with the blade guard covering the blade edge.
Figure 5:
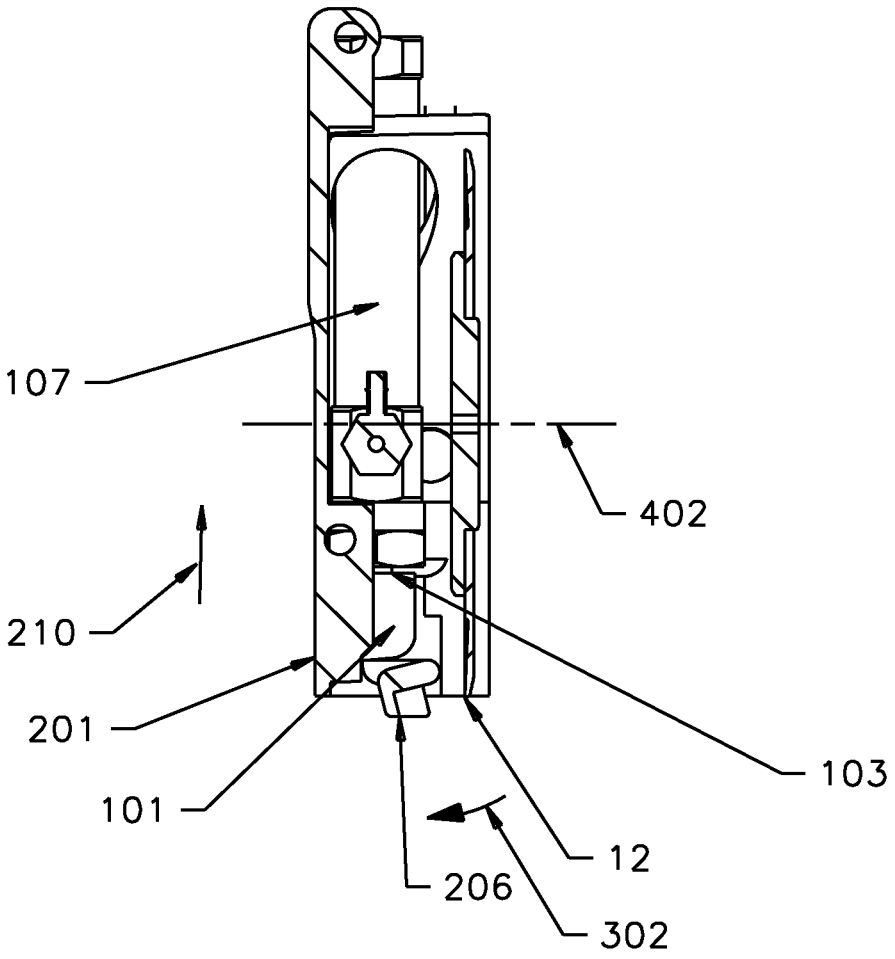
FIG. 5 is a section view of the guard actuation device, which in this view is shown with the guard retracted and the blade in the retracted not slitting position.

The embodiment includes a means of positioning the guard 206. The positioning means in this embodiment comprises a torsion spring 203 located near pivot surface 204A such that one end is attached to the web slitter cover 201 and the other end is attached to the guard 206. The attachment procedure includes loading the torsion spring 203 in such a way that the guard 206 is biased away from the web slitter blade edge 12 in direction 302 shown in FIG. 5. Referring to FIG. 4, a block 101 is located adjacent the web slitter cover 201, this block 101 is in contact with the guard 206 while the guard 206 is covering the web slitter blade edge 12. This maintains the guard 206 in a position which covers the web slitter blade edge 12.

Figure 3:
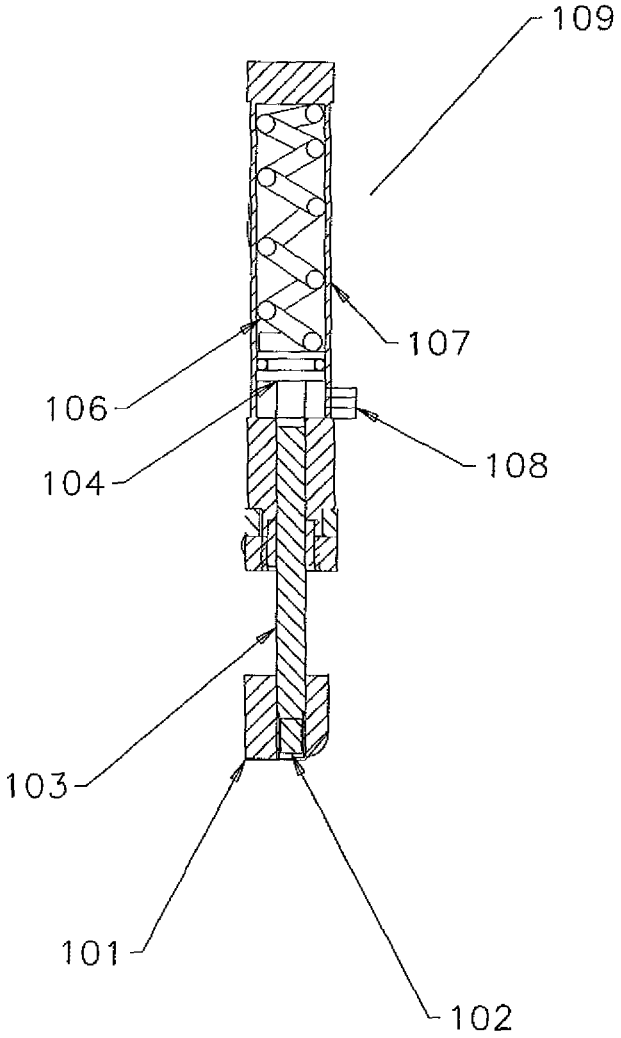
FIG. 3 is a section view of the blade actuator cylinder, block and retract spring.

A fluidic cylinder 109, shown in cross section in FIG. 3, is used as an actuator in this embodiment. The fluidic cylinder rod 103 has two ends, 102 and 104. End 102 is connected to the block 101 and the other end 104 is attached to a piston 105. The fluidic cylinder 105 has a body 107, a compression spring 106 and a fluid inlet port 108. This fluidic cylinder rod end 102 which is connected to the block 101. The compression spring 106 pushes the piston 105 and rod 103 such that the block 101 is positioned against the back side 209 of the guard 206 and the guard 206 is held such that it covers the web slitter blade edge 12.

During the slitting process the web slitter blade edge needs to be exposed to the slitting area 303. To move the guard 206 so that the web slitter blade edge 12 is exposed for use during slitting, the fluidic cylinder 109 is retracted by providing compressed fluid to the inlet port 108. This causes the fluidic cylinder 109 to pull the block 101 upward as shown in FIG. 3 by arrow 210. As explained above, the torsion spring 203 is biasing the guard 206 against the block 101, so as the block 101 moves upward, in the direction of the arrow 210, the torsion spring 203 causes the guard 206 to pivot about the pivot features 204 and 205 in the direction of the arrow 302 shown in FIG. 5. This exposes the web slitter blade edge 12 during slitting.

Positioning the guard 206 to cover the web slitter blade edge 12, is provided by removing compressed fluid from the inlet port 108. This allows the compression spring 106 to overcome the torsion spring 203 and causes the cylinder rod 103 and block 101 to move downward, as shown in FIG. 4 by arrow 211. This compression spring is able to overcome the torsion spring 203 so that the guard 202 then covers the web slitter blade edge 12.

At this point, a few of the features of the device should be noted. First, when the invention is in a state of rest (non-slitting use), no compressed fluid is needed to hold the guard 206 in a position that covers the web slitter blade edge 12. Only the torsion spring 203 holds the guard 206 against the block 101 and the block 101 is held in position by the compression spring 106. This accomplishes one of the goals of the invention, to cover the web slitter blade edge 12 while not in use. No effort, with the exception of disconnecting compressed fluid from the inlet port 108 is required to maintain the guard 206 in this covering position. Also, if a person should desire to expose the web slitter blade edge 12, he can simply push the block 101 toward the cylinder body 107 and cause the guard 206 to pivot. This accomplished a second goal of the invention which requires manual action to expose the web slitter blade edge 12.

Figure 9:
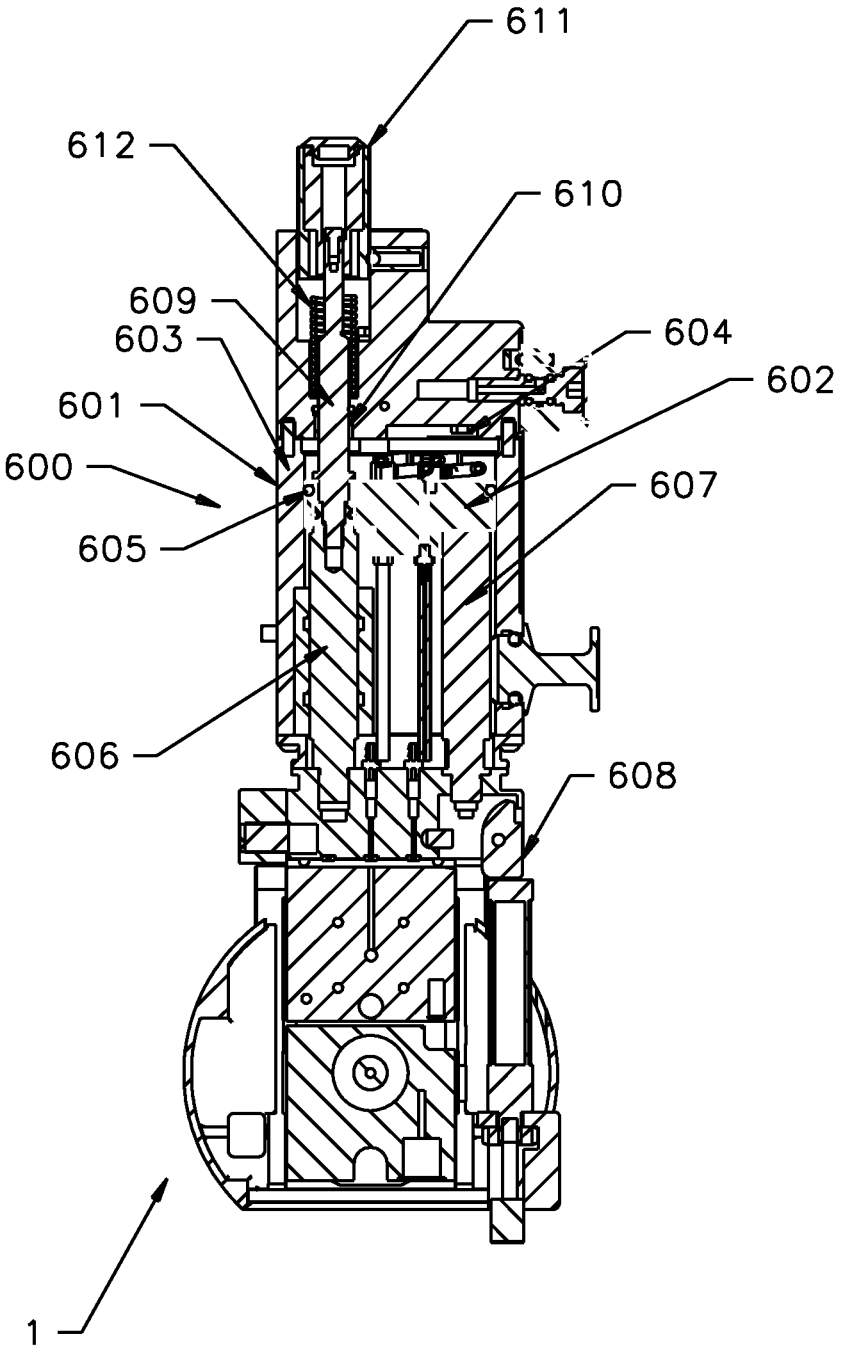
FIG. 9 is a section view of the knife holder and blade guard assembly in the blade retracted position.
Figure 10:
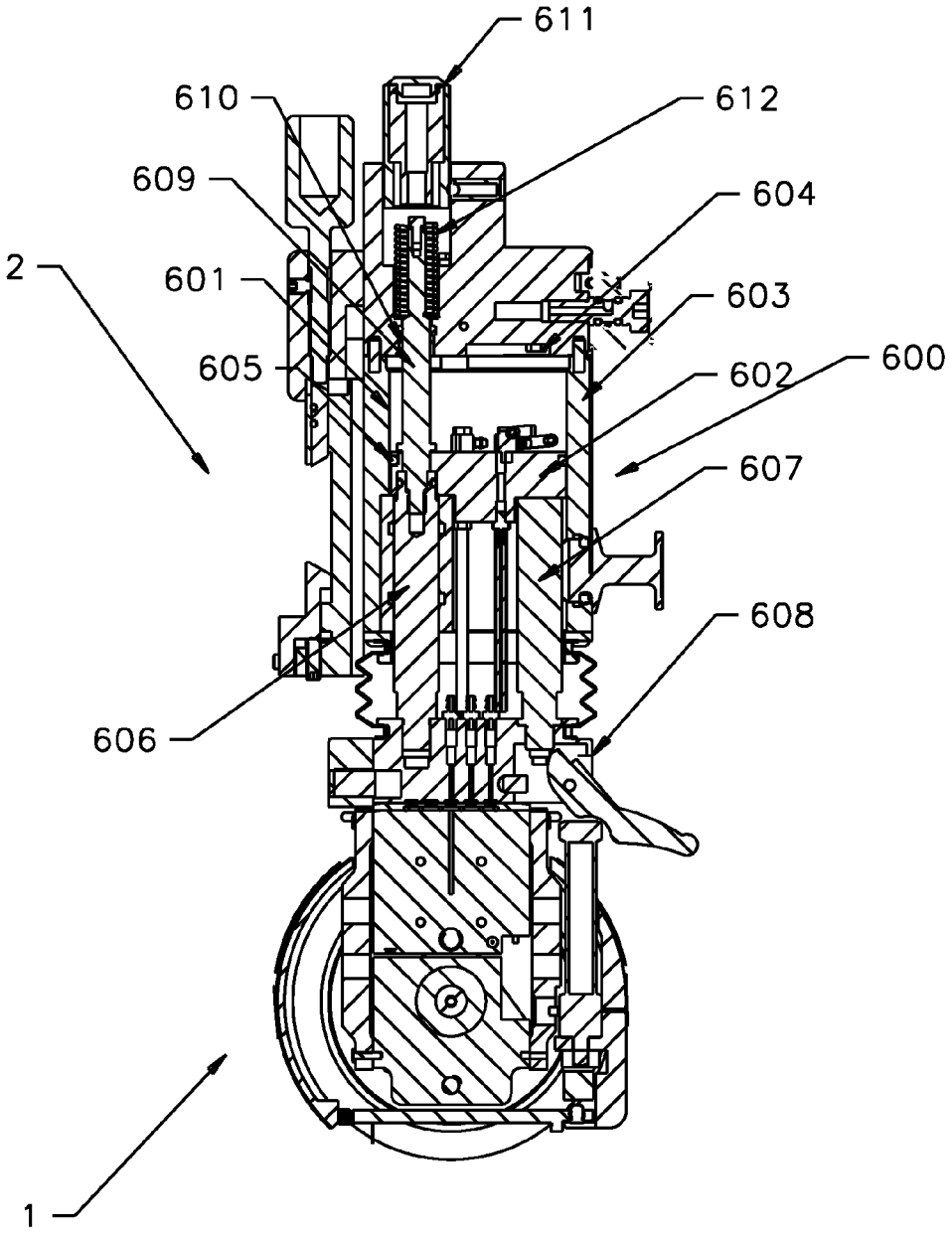
FIG. 10 is a section view of the knife holder and blade guard assembly in the blade extended position.

Next the coordination of the guard fluidic cylinder 109 and the vertical slitter blade cylinder 601 are explained. The knife holder 2 is shown in FIG. 1, FIGS. 9 and 10. In FIG. 9 the vertical slitter blade cylinder 601 is shown in the retracted position, in FIG. 10 it is shown in the extended position. This vertical movement of the blade 11 positions the blade 11 in a position for slitting. However, it should be noted that the knife holder 2 also provides a small amount of transverse motion which is not considered to be germane to the instant invention.

The body of the knife holder 600 includes a fluidic cylinder 601 for actuating the slitter blade 11 vertically. The cylinder piston 602 slides vertically inside the cylinder body 603 in response to compressed air applied to the inlet air fitting 604. An oring 605 is used to seal the compressed air and prevents the compressed air from escaping out of the cylinder body 600. The cylinder piston 602 is attached to vertical rods 606 and 607 respectively. These rods are attached to the blade holder assembly 608 which includes the slitter blade 11, and the slitter blade guard 1.

On the opposite side of the piston 602 is an additional rod 609. This rod is also attached to the piston 602 and passes thru the body 600 and into a concentric hole 610. Additionally, a knob 611 is attached to the end of the rod 609. The knob 611 and the body 600 enclose a spring 612 that pushes against the bottom of the knob 611 and so pushes the piston 602 and the rods 606 and 607 and the slitter blade 11 upward. This spring 612 is used to bias the piston upward and is selected such that, as air is supplied to the air inlet fitting 604 and to the guard cylinder inlet fitting 108, the guard cylinder 109 will retract first. As pressure builds up in the fluidic cylinder 601 the spring 612 is overcome and the piston 602 moves downward, taking the blade holder assembly 608 and the slitter blade 11 with it.

The invention teaches that linkages and springs can be used to maintain a guard 206 in a position that covers the blade edge 12 of a web slitter and provides for the retraction of the guard 206 prior to the extension of a slitter blade 12. Additionally, this embodiment includes a means of providing a person with easy intentional access to the slitter blade edge while still guarding against accidental blade exposure.

In most applications of the invention, the invention is mounted on a web slitter, which in turn is mounted to a production web handling device. While mounted in a machine compressed air is typically provided to the web slitter and also the cylinder inlet port of the invention. Detaching the web slitter from the machine includes disconnecting compressed air and so the cylinder inlet port mentioned above is also disconnected.

The inventor submits the above embodiment of the invention with the expressed understanding that this embodiment is simple one possible way of applying the invention and is not to be used to limit the claims.

We claim:

1. An apparatus for retracting a slitter blade guard which covers a slitter blade edge of a disk shaped slitter blade having an axis of rotation comprising;

a: a web slitter cover for mounting elements, b: a slitter blade guard having a pivot axis for pivoting that is perpendicular to said slitter blade axis of rotation and pivotally mounted to said web slitter cover to pivot about said pivot axis, c: a first spring for biasing said slitter blade guard toward an orientation which exposes said slitter blade edge, d: a moveably mounted block adapted for manual and fluidic cylinder actuation for resisting said first spring and maintaining said slitter blade guard in an orientation which covers said slitter blade edge, e: a means of positioning said moveably mounted block for allowing said first spring to retract said slitter blade guard wherein said means of positioning said moveably mounted block is a fluidic air cylinder.

2. The apparatus of claim 1 wherein said slitter blade guard comprises a lip for covering said slitter blade edge.

3. An apparatus for retracting a slitter blade guard which covers the edge of a disk shaped slitter blade having an axis of rotation comprising;

a: a web slitter cover for mounting elements, b: said slitter blade guard having a pivot axis that is perpendicular said slitter blade axis of rotation and pivotally mounted on said web slitter cover to pivot about said pivot axis, c: a means of biasing said slitter blade guard toward an orientation for exposing said edge of a disk shaped slitter blade mounted on said web slitter cover, d: a means of resisting and releasing said biasing means such that the slitter blade guard can be oriented to expose or cover said edge of a disk shaped slitter blade mounted on said web slitter cover by either manual or fluidic manipulation, wherein said means of resisting and releasing said biasing means is a moveably mounted block mounted on said web slitter cover wherein the moveably mounted block is biased in a resisting location causing said slitter blade guard to cover said edge, wherein said means of releasing said biasing means is a fluidic cylinder attached to said moveably mounted block.

* * * * *